US011474457B2

(12) United States Patent
Shimohora et al.

(10) Patent No.: US 11,474,457 B2
(45) Date of Patent: Oct. 18, 2022

(54) IMAGE FORMING APPARATUS THAT CAN SELECTIVELY SWITCH BETWEEN TWO TRANSFER ROLLERS

(71) Applicant: KYOCERA Document Solutions Inc., Osaka (JP)

(72) Inventors: Yuya Shimohora, Osaka (JP); Masayuki Yamada, Osaka (JP); Masaru Takagi, Osaka (JP); Takehiro Sato, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/578,308

(22) Filed: Jan. 18, 2022

(65) Prior Publication Data

US 2022/0236670 A1 Jul. 28, 2022

(30) Foreign Application Priority Data

Jan. 22, 2021 (JP) ..... JP2021-008921

(51) Int. Cl.
*G03G 15/16* (2006.01)

(52) U.S. Cl.
CPC ..... *G03G 15/1665* (2013.01)

(58) Field of Classification Search
CPC ..... G03G 15/1605; G03G 15/1645; G03G 15/1665
USPC ..... 399/66, 313
See application file for complete search history.

(56) References Cited

U.S. PATENT DOCUMENTS 11,194,270 B2 * 12/2021 Ando ..... G03G 15/1675
2017/0255133 A1 9/2017 Kubota et al.

FOREIGN PATENT DOCUMENTS

JP 2017-156653 A 9/2017

* cited by examiner

*Primary Examiner* — William J Royer
(74) *Attorney, Agent, or Firm* — Stein IP, LLC

(57) ABSTRACT

An image forming apparatus includes an image forming portion, an image input portion, a transfer unit, a transfer voltage power supply, and a control portion. The transfer unit includes a transfer roller having a metal shaft and an elastic layer laid around an outer circumferential face of the metal shaft to form a transfer nip by keeping the elastic layer in pressed contact with an image carrying member, and transfers a toner image formed on the image carrying member to a recording medium as it passes through the transfer nip. The transfer unit includes, as the transfer roller, a first roller, and a second roller having a larger axial-size elastic layer compared to the first roller. The control portion arranges the first or second roller opposite the image carrying member according to width-direction sizes of the recording medium and image data fed to the image input portion.

10 Claims, 13 Drawing Sheets

IMAGE FORMING APPARATUS THAT CAN SELECTIVELY SWITCH BETWEEN TWO TRANSFER ROLLERS

INCORPORATION BY REFERENCE

This application is based upon and claims the benefit of priority from the corresponding Japanese Patent Application No. 2021-8921 filed on Jan. 22, 2021, the entire contents of which are hereby incorporated by reference.

BACKGROUND

The present disclosure relates to an image forming apparatus provided with a transfer unit for transferring a toner image formed on an image carrying member such as a photosensitive drum and an intermediate transfer belt to a recording medium.

Conventionally, there is a known intermediate transfer-type image forming apparatus including an endless intermediate transfer belt that rotates in a prescribed direction and a plurality of image forming portions provided along the intermediate transfer belt. In the image forming apparatus, by the image forming portions, toner images of respective colors are primarily transferred to the intermediate transfer belt by being sequentially superimposed on each other, after which the toner images are secondarily transferred by a secondary transfer roller to a recording medium such as paper.

In such intermediate transfer-type image forming apparatuses, adhesion of toner to the surface of the secondary transfer roller accumulates due to durable printing. In particular, to improve the color development and the color reproducibly, it is necessary to execute calibration for correcting the image density and the color displacement with predetermined timing, and the patch image formed on the intermediate transfer belt during execution of calibration is, instead of being transferred to the sheet, removed by a belt cleaning device. This causes, as the patch image passes through the secondary transfer roller, part of the toner transferred to the intermediate transfer belt to adhere to the secondary transfer roller.

Conventionally, the secondary transfer roller is cleaned by applying a reverse transfer voltage (a voltage with the same polarity as the toner) to the secondary transfer roller during non-image forming period to send the toner deposited on the secondary transfer roller to the intermediate transfer belt. However, this method is disadvantageous in that cleaning of the secondary transfer roller takes time, resulting in longer printing wait time.

To cope with that, there have been proposed methods for improving productivity by permitting switching of the secondary transfer roller to the one of the size appropriate to the recording medium, and, for example, there is a known developing device that includes a plurality of secondary transfer rollers having different lengths in the axial direction, a rotary member that rotatably supports the plurality of secondary transfer rollers and in addition has a supporting portion that is pivotable about an axis parallel to the axial direction, and a control portion that selects one roller out of the plurality of secondary transfer rollers in accordance with the width of the recording medium and rotates the supporting portion to arrange the roller opposite the intermediate transfer belt.

SUMMARY

According to one aspect of the present disclosure, an image forming apparatus includes an image forming portion, an image input portion, a transfer unit, a transfer voltage power supply, and a control portion. The image forming portion forms a toner image on an image carrying member. The image input portion receives image data of the toner image formed by the image forming portion. The transfer unit includes a transfer roller having a metal shaft and an elastic layer laid around the outer circumferential face of the metal shaft to form a transfer nip by keeping the elastic layer in pressed contact with the image carrying member, and transfers the toner image formed on the image carrying member to a recording medium as it passes through the transfer nip. The transfer voltage power supply applies a voltage to the transfer roller. The control portion controls the image forming portion, the transfer unit, and the transfer voltage power supply. The transfer unit includes, as the transfer roller, a first roller and a second roller. The elastic layer of the second roller is larger in the axial direction than that of the first roller. The control portion arranges one of the first and second rollers at a reference position at which the first or second roller is in pressed contact with the image carrying member and forms the transfer nip in accordance with a width-direction size of the image data that has been fed to the image input portion and a width-direction size of the recording medium.

DETAILED DESCRIPTION

Figure 1:
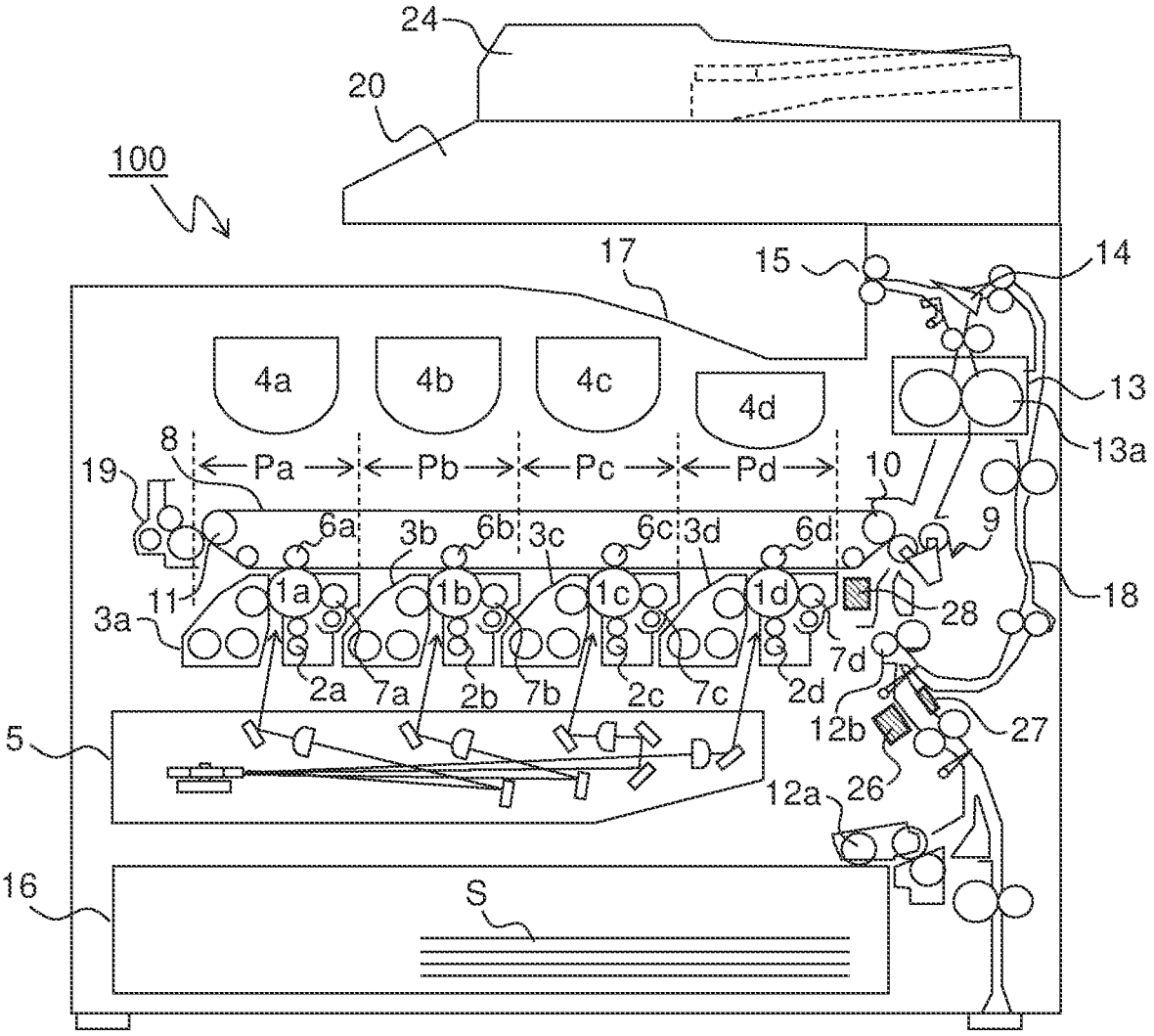
FIG. 1 is a schematic view showing an internal configuration of an image forming apparatus according to one embodiment of the present disclosure.
Figure 2:
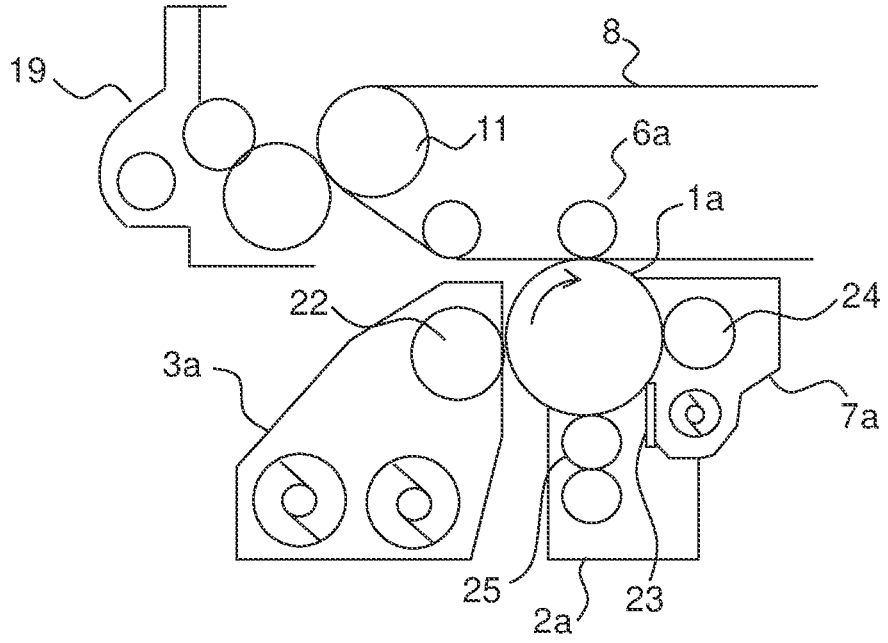
FIG. 2 is an enlarged view of and around an image forming portion in FIG. 1.

Hereinafter, with reference to the accompanying drawings, embodiments of the present disclosure will be described. FIG. 1 is a schematic diagram showing the configuration of an image forming apparatus 100 according to one embodiment of the present disclosure, and FIG. 2 is an enlarged view of and around an image forming portion Pa in FIG. 1.

The image forming apparatus 100 shown in FIG. 1 is what is called a tandem-type color printer and is configured as follows. In the main body of the image forming apparatus 100, four image forming portions Pa. Pb, Pc and Pd are arranged in this order from upstream in the conveying direction (from the left side in FIG. 1). The image forming portions Pa to Pd are provided so as to correspond to images of four different colors (magenta, cyan, yellow, and black) and sequentially form images of magenta, cyan, yellow, and black, respectively, by following the steps of electrostatic charging, exposure to light, image development, and image transfer.

In these image forming portions Pa to Pd, photosensitive drums 1*a*, 1*b*, 1*c*, and 1*d* are respectively arranged which carry visible images (toner images) of the different colors. Furthermore, an intermediate transfer belt 8 which rotates counter-clockwise in FIG. 1 is provided adjacent to the image forming portions Pa to Pd. The toner images formed on the photosensitive drums 1*a* to 1*d* are transferred sequentially to the intermediate transfer belt 8 that moves while keeping contact with the photosensitive drums 1*a* to 1*d* and then, in a secondary transfer unit 9, transferred at once to a sheet S, which is one example of a recording medium. Then, after the toner images are fixed on the sheet S in a fixing portion 13, the sheet is discharged from the main body of the image forming apparatus 100. An image forming process is performed with respect to the photosensitive drums 1*a* to 1*d* while they are rotated clockwise in FIG. 1.

The sheet S to which the toner images are transferred is stored in a sheet cassette 16 arranged in a lower part of the main body of the image forming apparatus 100, and is conveyed via a sheet feeding roller 12*a* and a pair of registration rollers 12*b* to the secondary transfer unit 9. Used typically as the intermediate transfer belt 8 is a belt without seams (seamless belt).

Next, a description will be given of the image forming portions Pa to Pd. The image forming portion Pa will be described in detail below. Since the image forming portions Pb to Pd have basically similar structures, no overlapping description will be repeated. As shown in FIG. 2, around the photosensitive drum 1*a*, there are arranged, in the drum rotation direction (clockwise in FIG. 2), a charging device 2*a*, a developing device 3*a*, a cleaning device 7*a*, and, across the intermediate transfer belt 8, a primary transfer roller 6*a*. In addition, upstream in the rotation direction of the intermediate transfer belt 8 with respect to the photosensitive drum 1*a*, a belt cleaning unit 19 is arranged so as to face a tension roller 11 across the intermediate transfer belt 8.

Next, a description will be given of an image forming procedure on the image forming apparatus 100. When a user enters an instruction to start image formation, first, a main motor 60 (see FIG. 8) starts rotating the photosensitive drums 1*a* to 1*d*, and charging rollers 25 in the charging devices 2*a* to 2*d* electrostatically charge the surfaces of the photosensitive drums 1*a* to 1*d* uniformly. Next, an exposure device 5 irradiates the surfaces of the photosensitive drums 1*a* to 1*d* with a beam of light (laser light) to form on them electrostatic latent images reflecting an image signal.

The developing devices 3*a* to 3*d* are loaded with predetermined amounts of toner of magenta, cyan, yellow, and black respectively. When, through formation of toner images, which will be described later, the proportion of toner in the two-component developer stored in the developing devices 3*a* to 3*d* falls below a determined value, toner is supplied from toner containers 4*a* to 4*d* to the developing devices 3*a* to 3*d* respectively. The toner in the developer is fed from developing rollers 22 in the developing devices 3*a* to 3*d* to the photosensitive drums 1*a* to 1*d* respectively, and electrostatically attaches to them. In this way, toner images corresponding to the electrostatic latent images formed through exposure to light from the exposure device 5 are formed.

Then, the primary transfer rollers 6*a* to 6*d* apply electric fields of a prescribed transfer voltage between themselves and the photosensitive drums 1*a* to 1*d*, and thus the toner images of magenta, cyan, yellow, and black respectively on the photosensitive drums 1*a* to 1*d* are primarily transferred onto the intermediate transfer belt 8. These images of four colors are formed in a predetermined positional relationship with each other that is prescribed for formation of a predetermined full-color image. After that, in preparation for the subsequent formation of new electrostatic latent images, the residual toner remaining on the surfaces of the photosensitive drums 1*a* to 1*d* is removed by cleaning blades 23 and rubbing rollers 24 in the cleaning devices 7*a* to 7*d*.

As a driving roller 10 is driven to rotate by a belt drive motor 61 (see FIG. 8) and the intermediate transfer belt 8 starts to rotate counterclockwise, the sheet S is conveyed with predetermined timing from the pair of registration rollers 12*b* to the secondary transfer unit 9 provided adjacent to the intermediate transfer belt 8, where the full-color image is transferred to it. The sheet S to which the toner images have been transferred is conveyed to the fixing portion 13. Toner remaining on the surface of the intermediate transfer belt 8 is removed by the belt cleaning unit 19.

The sheet S conveyed to the fixing portion 13 is heated and pressed by a pair of fixing rollers 13*a* so that the toner images are fixed on the surface of the sheet S, and thus the prescribed full-color image is formed on it. The conveyance direction of the sheet S on which the full-color image has been formed is switched by a branch portion 14 branching into a plurality of directions, and thus the sheet S is directly (or after being conveyed to a double-sided conveyance path 18 and thus being subjected to double-sided printing) discharged onto a discharge tray 17 by a pair of discharge rollers 15.

An image reading portion 20 is arranged over the discharge tray 17, and a document conveying device 24 is provided on the top face of the image reading portion 20. The image reading portion 20 includes a scanning optical system including a scanner lamp for illuminating a document during copying and a mirror for deflecting the optical path of the light reflected from the document, a condenser lens for converging and focusing the light reflected from the document, a CCD sensor for converting the focused image light into an electrical signal (none are illustrated). The image reading portion 20 reads a document image and converts it into image data. The document conveying device 24 automatically conveys a sheet-form document to a reading position on the image reading portion 20.

A CIS (contact image sensor) 26 is arranged upstream of the pair of registration rollers 12*b* in the sheet conveying direction. An LED 27 is arranged at a position opposite the CIS 26 across a sheet conveying passage. The CIS 26 has a number of sensing portions (not shown) comprising photoelectric conversion elements arranged in the sheet width direction. The CIS 26, based on the difference in light intensity between, of the sensing portions, the part directly struck by the light emitted from the LED 27 and the part shielded by a sheet S from the light emitted from the LED 27, senses the position of an edge part of the sheet S in its width direction (the direction perpendicular to the sheet conveying direction). The sensing result is transmitted to a control portion 90 (see FIG. 8).

Here, the LED 27 is arranged at a position opposite the CIS 26 across the sheet conveying passage; instead, a configuration is also possible where the LED 27 is arranged on the same side as the CIS 26 with respect to the sheet conveying passage and a reflector is arranged at a position opposite the CIS 26, so that the light emitted from the LED 27 is reflected on the reflector and then strikes the detection portion of the CIS 26.

An image density sensor 28 is arranged at a position opposite the driving roller 10 across the intermediate transfer belt 8. As the image density sensor 28, an optical sensor is typically used that includes a light-emitting element comprising an LED or the like and a light-receiving element comprising a photodiode or the like. To measure the amount of toner attached to the intermediate transfer belt 8, patch images (reference images) formed on the intermediate transfer belt 8 are irradiated with measurement light from the light-emitting element, so that the measurement light strikes the light-receiving element as light reflected by the toner and light reflected by the belt surface.

The light reflected from the toner and the belt surface includes a regularly reflected light component and an irregularly reflected light component. The regularly and irregularly reflected light are separated with a polarization splitting prism and strike separate light-receiving elements respectively. Each of the light-receiving elements performs photoelectric conversion on the received regularly or irregularly reflected light and outputs an output signal to the control portion 90 (see FIG. 8).

Then, from the change in the characteristics of the output signals with respect to the regularly and irregularly reflected light, the image density (toner amount) and the image position in the patch images are determined and compared with a predetermined reference density and a predetermined reference position to adjust the characteristic value of the developing voltage, the start position and the start timing of exposure by the exposure device 5, and so on. In this way, for each of the different colors, density correction and color displacement correction (calibration) are performed.

Figure 3:
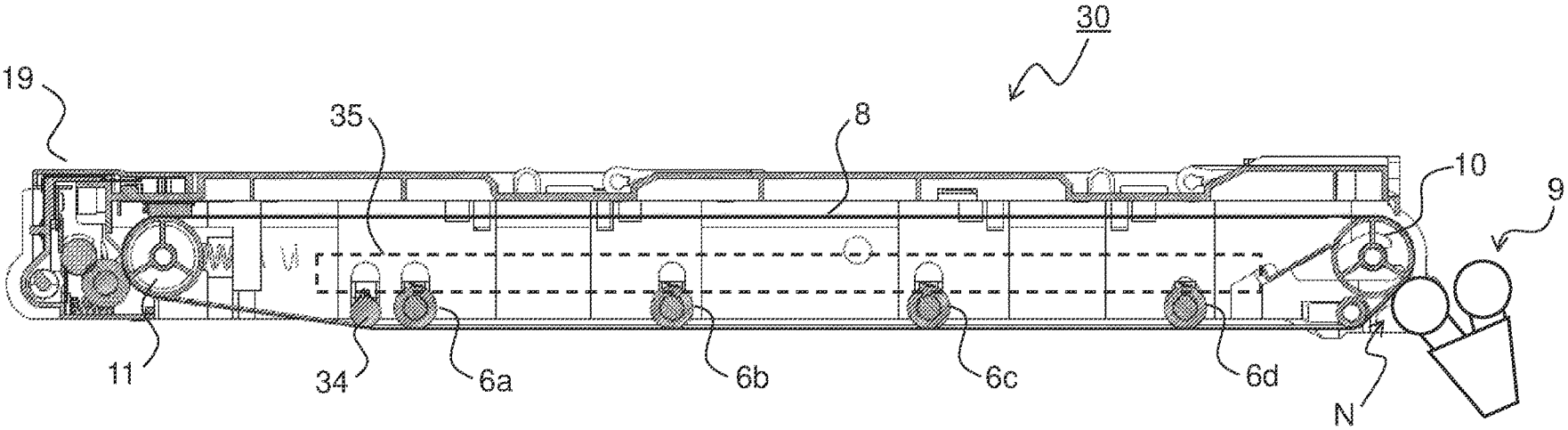
FIG. 3 is a side sectional view of an intermediate transfer unit incorporated in the image forming apparatus according to the embodiment.

FIG. 3 is a side sectional view of an intermediate transfer unit 30 mounted in the image forming apparatus 100. As shown in FIG. 3, the intermediate transfer unit 30 includes the intermediate transfer belt 8 that is stretched between the driving roller 10 on the downstream side and the tension roller 11 on the upstream side, the primary transfer rollers 6*a* to 6*d* that are in contact with the photosensitive drums 1*a* to 1*d* via the intermediate transfer belt 8, and a pressing state switching roller 34.

The belt cleaning unit 19 for removing the residual toner remaining on the surface of the intermediate transfer belt 8 is arranged at a position opposite the tension roller 11. With the driving roller 10, the secondary transfer unit 9 is kept in pressed contact via the intermediate transfer belt 8, forming a secondary transfer nip N. The detailed configuration of the secondary transfer unit 9 will be described later.

The intermediate transfer unit 30 includes a roller contact/release mechanism 35 including a pair of support members (not shown) that supports the opposite ends of the rotary shaft of each of the primary transfer rollers 6*a* to 6*d* and the pressing state switching roller 34 so that they are rotatable and movable perpendicularly (in the up-down direction in FIG. 3) with respect to the travel direction of the intermediate transfer belt 8, a driving means (not shown) for driving the primary transfer rollers 6*a* to 6*d* and the pressing state switching roller 34 to reciprocate in the up-down direction. The roller contact/release mechanism 35 permits switching among a color mode in which the four primary transfer rollers 6*a* to 6*d* are in pressed contact with the photosensitive drums 1*a* to 1*d*, respectively, via the intermediate transfer belt 8 (see FIG. 1), a monochrome mode in which only the primary transfer roller 6*d* is in pressed contact with the photosensitive drum 1*d* via the intermediate transfer belt 8, and a release mode in which the four primary transfer rollers 6*a* to 6*d* are all released from the photosensitive drums 1*a* to 1*d*, respectively.

Figure 4:
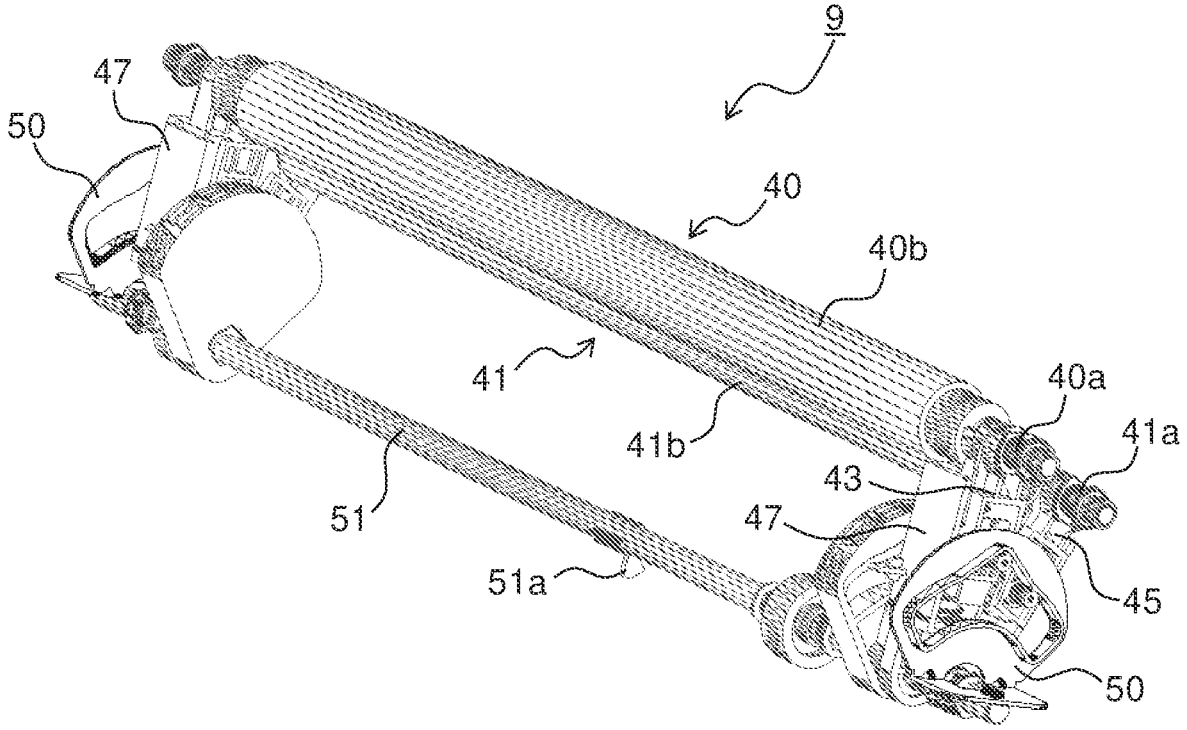
FIG. 4 is a perspective view of a secondary transfer unit incorporated in the image forming apparatus according to the embodiment.
Figure 5:
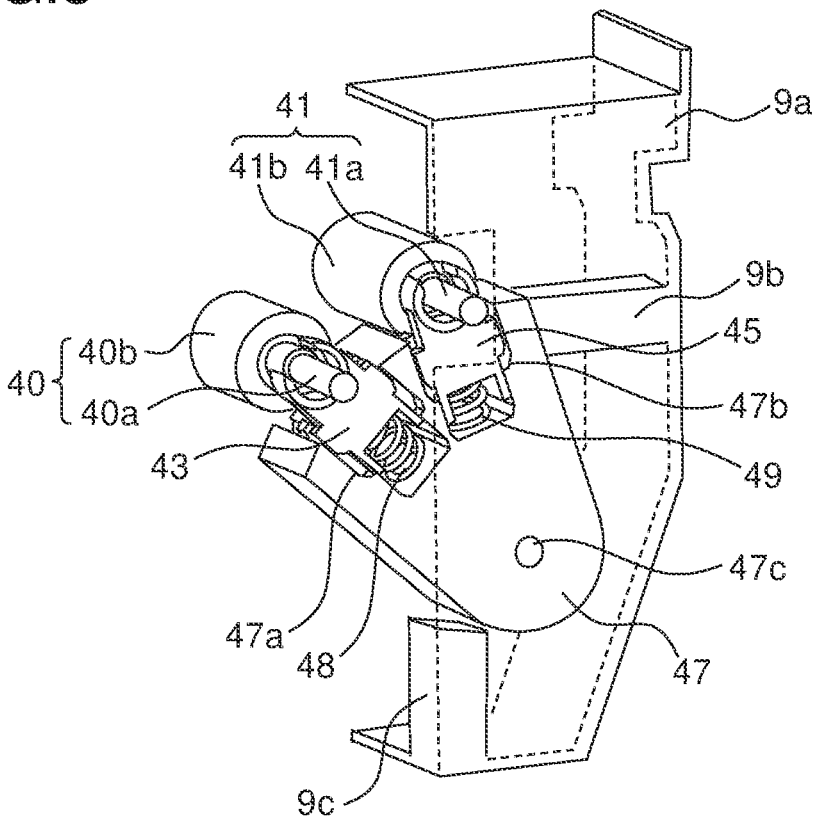
FIG. 5 is an enlarged perspective view illustrating the configuration of the secondary transfer unit at one end.
Figure 6:
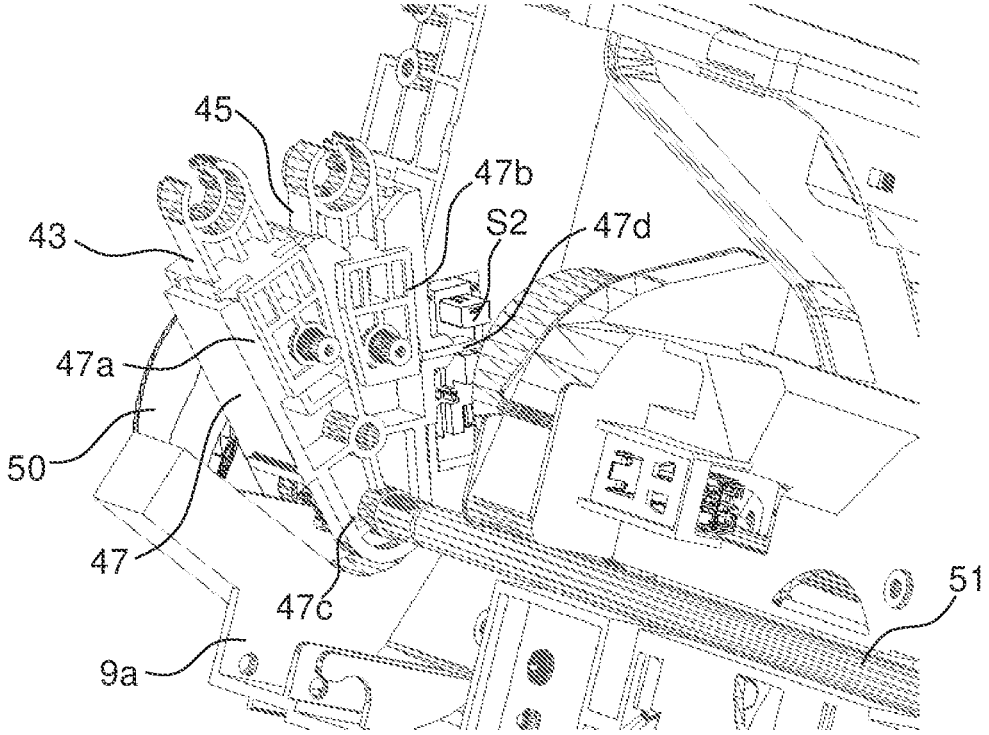
FIG. 6 is a perspective view of and around a roller holder in the secondary transfer unit as seen from beneath.
Figure 7:
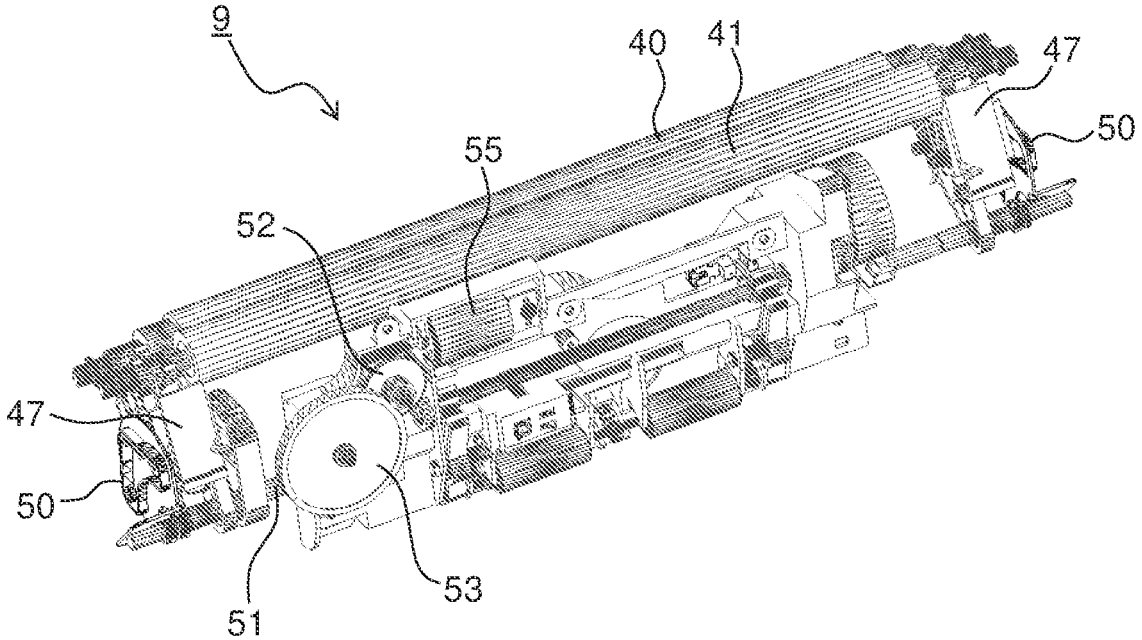
FIG. 7 is a perspective view illustrating a driving mechanism for the secondary transfer unit.

FIG. 4 is a perspective view of the secondary transfer unit 9 mounted in the image forming apparatus 100. FIG. 5 is an enlarged perspective view illustrating the configuration of the secondary transfer unit 9 at one end. FIG. 6 is a perspective view of and around a roller holder 47 in the secondary transfer unit 9 as seen from beneath. FIG. 7 is a perspective view illustrating the driving mechanism for the secondary transfer unit 9. In FIGS. 4 and 7, a unit frame 9*a* is omitted from illustration. In FIG. 5, the unit frame 9*a* is illustrated with phantom lines.

As shown in FIGS. 4 to 7, the secondary transfer unit 9 includes a first roller 40 and a second roller 41 as a secondary transfer roller, a first bearing member 43, a second bearing member 45, the roller holder 47, a switching cam 50, and a roller switching motor 55.

The first and second rollers 40 and 41 are elastic rollers having electrically conductive elastic layers 40*b* and 41*b* laid around outer circumferential faces of the metal shafts 40*a* and 41*a* respectively. Used as the material for the elastic layers 40*b* and 41*b* is, for example, ion conductive rubber such as ECO (epichlorohydrin rubber).

The elastic layer 40*b* of the first roller 40 is 311 millimeters long in the axial direction and is compatible with the A3-size sheet. The elastic layer 41*b* of the second roller 41 is longer than the elastic layer 40*b* of the first roller 40 in the axial direction. More specifically, the elastic layer 41*b* is 325 millimeters long in the axial direction and is compatible with the 13 inch-size sheet.

A pair of first bearing members 43 are arranged in opposite end parts of the first roller 40 in the axial direction so as to rotatably support the metal shaft 40*a*. A pair of second bearing members 45 are arranged in opposite end parts of the second roller 41 in the axial direction so as to rotatably support the metal shaft 41*a*.

A pair of roller holders 47 are arranged in opposite end parts of the first and second rollers 40 and 41 in the axial direction. The roller holder 47 is in a V-shape as seen in a side view and has a first bearing holding portion 47*a*, a second bearing holding portion 47*b*, and an insertion hole 47*c*. The first and second bearing holding portions 47*a* and 47*b* slidably support the first and second bearing members 43 and 45 respectively. The insertion hole 47*c* is formed near the vertex of the V-shape, and is rotatably penetrated by a shaft 51. The roller holder 47 is formed of an electrically insulating material such as synthetic resin.

As shown in FIG. 5, between the first bearing holding portion 47*a* and the first bearing member 43, a first coil spring 48 (first urging member) is arranged. Between the second bearing holding portion 47*b* and the second bearing member 45, a second coil spring 49 (second urging member) is arranged. The first and second rollers 40 and 41 are urged by the first and second coil springs 48 and 49 respectively in a direction away from the shaft 51 (the direction for pressed contact with the driving roller 10).

As shown in FIG. 4, the shaft 51 is fitted with a first light-shielding plate 51*a* that, by shielding a sensing portion of a first position sensor S1 (see FIG. 9) from light, makes it possible to sense the rotating angle of the shaft 51. As shown in FIG. 6, on one side face of the roller holder 47 in the rotation direction, a second light-shielding plate 47*d* is formed. The second light-shielding plate 47*d* is formed at a position where it can shield from light a sensing portion of a second position sensor S2 arranged on the unit frame 9*a*.

The first and second light-shielding plates 51*a* and the 47*d* turn on and off the first and second position sensors S1 and S2 respectively in accordance with the rotating angle of the roller holder 47 (shaft 51), and this makes it possible to sense the position of the first and second rollers 40 and 41 supported on the roller holder 47. The control for sensing the position of the first and second rollers 40 and 41 will be described later.

A pair of switching cams 50 are arranged in opposite end parts of the first and second rollers 40 and 41 in the axial direction, outward of the roller holders 47. The switching cam 50 is in a fan shape as seen in a side view, with the hinge portion of the fan (near the vertex at which two radial lines intersect) fastened to the shaft 51. As shown in FIG. 7, the roller switching motor 55 is coupled to the shaft 51 via gears 52 and 53. Rotating the switching cam 50 together with the shaft 51 permits the arrangement of the first and second rollers 40 and 41 to be switched. The control for switching between the first and second rollers 40 and 41 will be described later.

Figure 8:
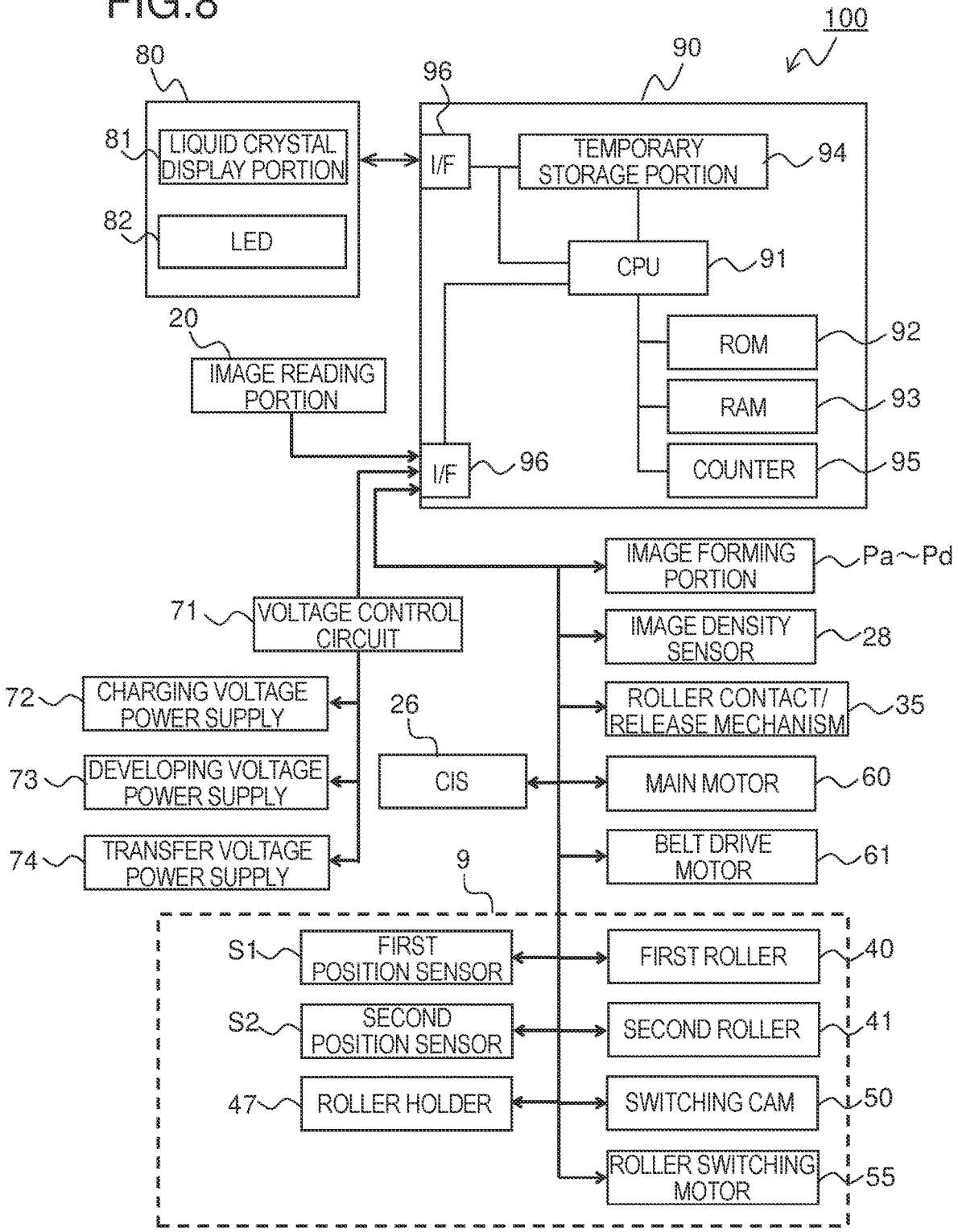
FIG. 8 is a block diagram showing one example of control paths in the image forming apparatus according to the embodiment.

FIG. 8 is a block diagram showing one example of the control paths in the image forming apparatus 100 mounted with the secondary transfer unit 9 according to the embodiment. In actual use of the image forming apparatus 100, different parts of it are controlled in different ways across complicated control paths all over the image forming apparatus 100. To avoid complexity, the following description focuses on those control paths which are necessary for implementing the present disclosure.

The control portion 90 includes at least a CPU (central processing unit) 91 as a central arithmetic processor, a ROM (read-only memory) 92 as a read-only storage portion, a RAM (random-access memory) 93 as a readable/writable storage portion, a temporary storage portion 94 that temporarily stores image data or the like, a counter 95, and a plurality of (here, two) I/Fs (interfaces) 96 that transmit control signals to different devices in the image forming apparatus 100 and receive input signals from an operation section 80. Furthermore, the control portion 90 can be arranged at any location inside the main body of the image forming apparatus 100.

The ROM 92 stores data and the like that are not changed during use of the image forming apparatus 100, such as control programs for the image forming apparatus 100 and numerical values required for control. The RAM 93 stores necessary data generated in the course of controlling the image forming apparatus 100, data temporarily required for control of the image forming apparatus 100, and the like. Furthermore, the RAM 93 (or the ROM 92) also stores a density correction table used in calibration, a threshold value of the size of the sheets used in roller switching control, which will be described later, and the like. The counter 95 counts the number of sheets printed in a cumulative manner.

The control portion 90 transmits control signals to different parts and devices in the image forming apparatus 100 from the CPU 91 through the I/F 96. From the different parts and devices, signals that indicate their statuses and input signals are transmitted through the I/F 96 to the CPU 91. Examples of the various portions and devices controlled by the control portion 90 include the image forming portions Pa to Pd, the exposure device 5, the primary transfer rollers 6*a* to 6*d*, the secondary transfer unit 9, the image reading portion 20, the roller contact/release mechanism 35, the main motor 60, the belt drive motor 61, a voltage control circuit 71, and the operation section 80.

The voltage control circuit 71 is connected to a charging voltage power supply 72, a developing voltage power supply 73, a transfer voltage power supply 74, and operates these power supplies in accordance with output signals from the control portion 90. In response to control signals from the voltage control circuit 71, the charging voltage power supply 72, the developing voltage power supply 73, and the transfer voltage power supply 74 apply predetermined voltages to the charging roller 25 in the charging devices 2*a* to 2*d*, to the developing roller 21 in the developing devices 3*a* to 3*d*, and to the primary transfer rollers 6*a* to 6*d* and the first and second rollers 40 and 41 in the secondary transfer unit 9 respectively.

The operation section 80 includes a liquid crystal display portion 81 and LEDs 82 that indicate various statuses. A user operates a stop/clear button on the operation section 80 to stop image formation and operates a reset button on it to bring various settings for the image forming apparatus 100 to default ones. The liquid crystal display portion 81 indicates the status of the image forming apparatus 100 and displays the progress of image formation and the number of copies printed. Various settings for the image forming apparatus 100 are made via a printer driver on a personal computer.

Figure 9:
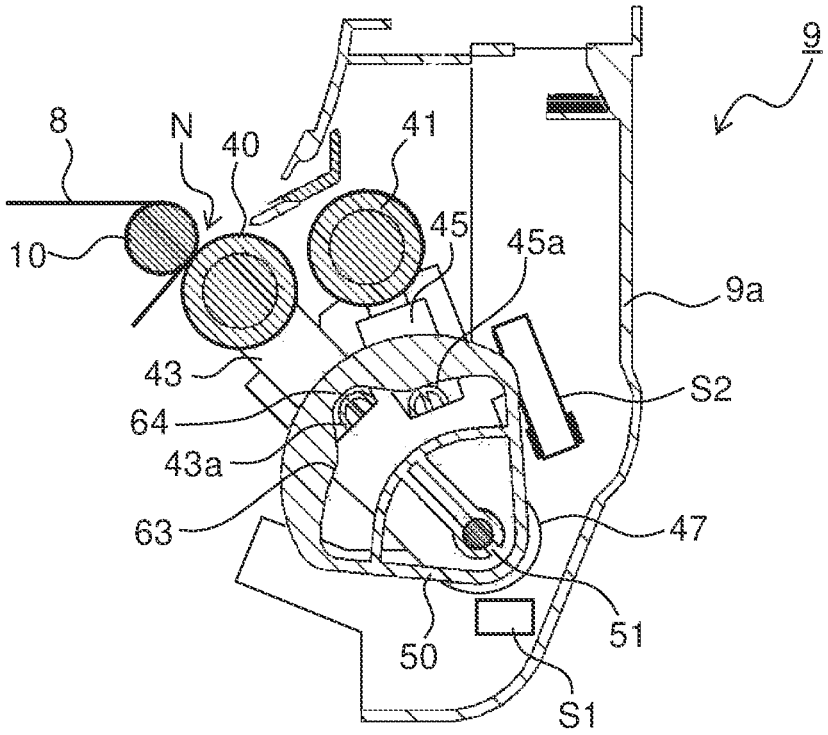
FIG. 9 is a cross-sectional side view of and around a switching cam in the secondary transfer unit, illustrating a state where a first roller is arranged at a reference position where it forms a secondary transfer nip.
Figure 10:
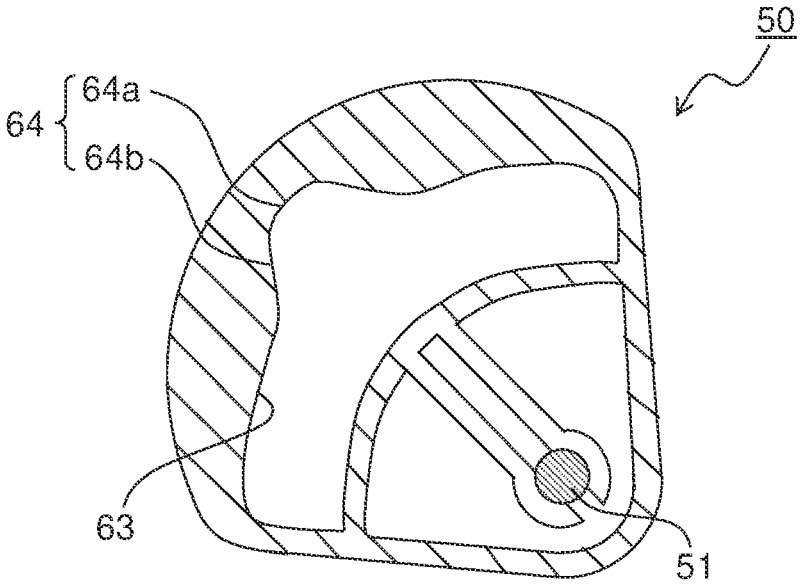
FIG. 10 is a plan view of the switching cam.

Next, a description will be given of switching control and position sensing control for the first and second rollers 40 and 41 in the secondary transfer unit 9 in the image forming apparatus 100 according to the embodiment. FIG. 9 is a cross-sectional side view of and around the switching cam 50 in the secondary transfer unit 9 according to the embodiment, illustrating a state where the first roller 40 is arranged at a position where it forms the secondary transfer nip N. FIG. 10 is a plan view of the switching cam 50.

As shown in FIG. 9, the switching cam 50 has an arc-shaped guide hole 63 formed in it. A recessed portion 64 is formed in the middle of the outer circumferential edge of the guide hole 63 in the radial direction. The first and second bearing members 43 and 45 respectively have a first engaging portion 43*a* and a second engaging portion 45*a* formed on them that engage with the guide hole 63.

As shown in FIG. 10, the recessed portion 64 of the switching cam 50 is in a trapezoid shape as seen in a plan view and has a bottom portion 64*a* corresponding to the upper side of the trapezoid and inclined portions 64*b* corresponding to the hypotenuses of the trapezoid. As the switching cam 50 rotates, the first engaging portion 43*a* of the first bearing member 43 and the second engaging portion 45*a* of the second bearing member 45 either engage with the bottom portion 64*a* or the inclined portions 64*b* of the recessed portion 64, or lie away from the recessed portion 64, thereby allowing the state of contact of the first and second rollers 40 and 41 with respect to the intermediate transfer belt 8 to be switched as will be described later.

In the state in FIG. 9, the first engaging portion 43*a* of the first bearing member 43 engages with the bottom portion 64*a* of the recessed portion 64. Thus, under the urging force of the first coil spring 48 (see FIG. 5), the first roller 40 is kept in pressed contact with the driving roller 10 via the intermediate transfer belt 8 to form the secondary transfer nip N. and the first roller 40 rotates by following the driving roller 10. To the first roller 40, a transfer voltage of the polarity (here, negative) opposite to that of toner is applied by the transfer voltage power supply 74 (see FIG. 8). Specifically, when the first roller 40 is arranged at the position in FIG. 9, the transfer voltage is applied to it via the first bearing member 43 that is electrically connected to the transfer voltage power supply 74.

The first light-shielding plate 51*a* (see FIG. 4) on the shaft 51 shields light from the sensing portion of the first position sensor S1 (on), and the second light-shielding plate 47*d* (see FIG. 6) on the roller holder 47 shields light from the sensing portion of the second position sensor S2 (*on*). This state (S1/S2 on) is taken as the reference position (home position) of the first roller 40. By restricting the rotating angle of the switching cam 50 based on the rotation time of the switching cam 50 from this reference position, the arrangement and the released state of the first roller 40 are controlled.

Figure 11:
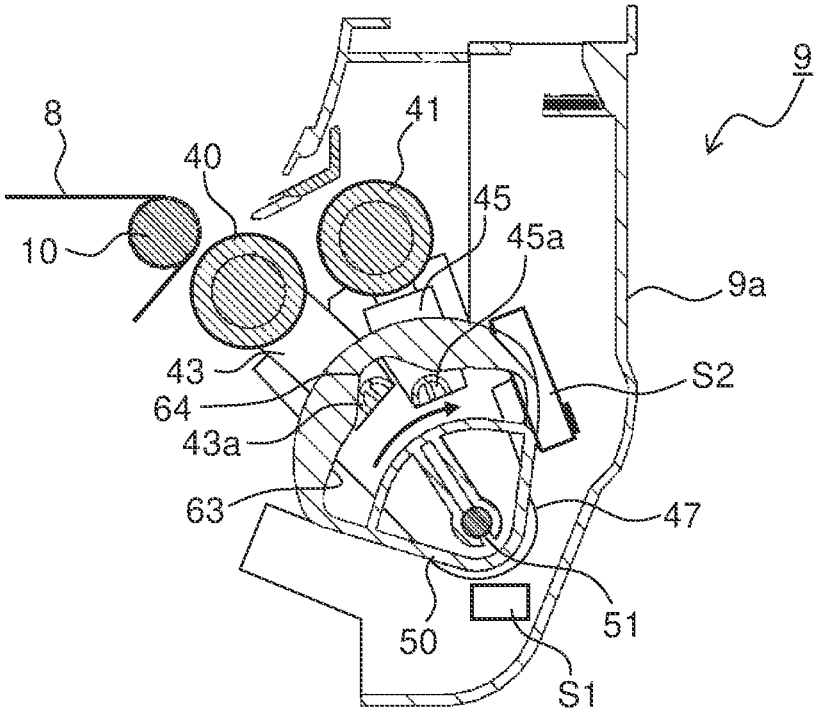
FIG. 11 is a diagram showing a first released state of the first roller where the switching cam is rotated clockwise from the state in FIG. 9 through a predetermined angle.

FIG. 11 is a diagram showing a state where the switching cam 50 is rotated clockwise from the state in FIG. 9 through a predetermined angle (here, 10.6° from the reference position in FIG. 9). When the shaft 51 is rotated clockwise, the switching cam 50 rotates along with the shaft 51. On the other hand, the roller holder 47 is restrained from clockwise rotation by a restriction rib 9*b* (see FIG. 5). As a result, the first engaging portion 43*a* of the first bearing member 43 moves from the bottom portion 64*a* to the inclined portion 64*b* of the recessed portion 64, and the first bearing member 43 moves in the direction toward the shaft 51 against the urging force of the first coil spring 48 (see FIG. 5). Thus, the first roller 40 lies slightly (2 mm) away from the intermediate transfer belt 8 (a first released state).

When the first roller 40 is kept in pressed contact with the driving roller 10 for a long time, the first roller 40 may yield and deform in the axial direction. To avoid that, after a job, the first roller 40 needs to be kept away from the intermediate transfer belt 8 (driving roller 10). This is achieved in the first released state shown in FIG. 11.

The first light-shielding plate 51*a* on the shaft 51 is retracted from the sensing portion of the first position sensor S1 (*off*), and the second light-shielding plate 47*d* on the roller holder 47 keeps shielding light from the sensing portion of the second position sensor S2 (*on*). That is, when the sensing state changes from the one in FIG. 9 (S1/S2 on) to the one in FIG. 11 (S1 off/S2 on), the first roller 40 can be sensed to have moved from the reference position to the first released state.

Figure 12:
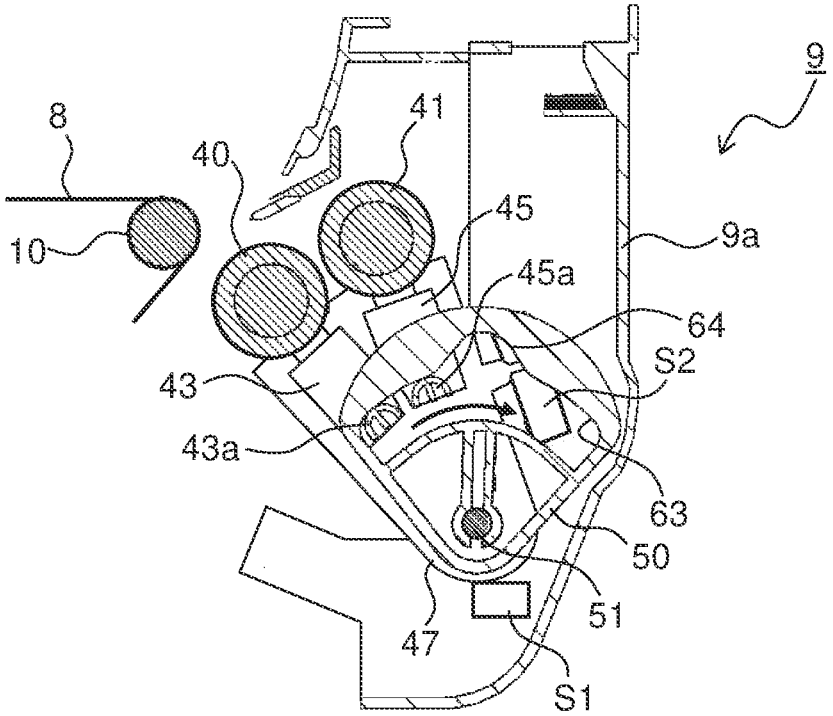
FIG. 12 is a diagram showing a second released state of the first roller where the switching cam is rotated further clockwise from the state in FIG. 11 through a predetermined angle.

FIG. 12 is a diagram showing a state where the switching cam 50 is rotated further clockwise from the state in FIG. 11 through a predetermined angle (here, 46.4° from the reference position in FIG. 9). When the shaft 51 is rotated further clockwise, the switching cam 50 rotates further clockwise along with the shaft 51. On the other hand, the roller holder 47 is restrained from clockwise rotation by the restriction rib 9*b* (see FIG. 5). As a result, the first engaging portion 43*a* of the first bearing member 43 moves away from the recessed portion 64, and the first bearing member 43 moves further in the direction toward the shaft 51 against the urging force of the first coil spring 48 (see FIG. 5). Thus, the first roller 40 lies completely (6.5 mm) away from the intermediate transfer belt 8 (a second released state). The second released state is used only for switching from the first roller 40 to the second roller 41.

The sensing state of the first and the second position sensors S1 and S2 in FIG. 12 is similar to that in the first released state (S1 off/S2 on) shown in FIG. 11. Thus, when the S1 off/S2 on state is sensed as the image forming apparatus 100 starts up, the roller holder 47 is rotated for a given period toward the main body of the image forming apparatus 100 (counter-clockwise) to distinguish between the first and second released states. Then, if the S1/S2 on state occurs, the first released state is recognized and, if the S1/S2 on state does not occur, the second released state is recognized.

To shift the first roller 40 in the second released state back to the reference position, it is necessary to rotate the roller holder 47 and the switching cam 50 counter-clockwise first to switch to the reference position of the second roller 41 (see FIG. 14) and then to switch back to the reference position of the first roller 40 (see FIG. 9).

Next, a description will be given of a procedure for switching the roller that forms the secondary transfer nip N from the first roller 40 to the second roller 41. When the shaft 51 is rotated counter-clockwise from the state in FIG. 12, the switching cam 50 rotates counter-clockwise along with the shaft 51. Also, the first and second bearing members 43 and 45 are urged in a direction away from the shaft 51 under the urging forces of the first and second coil springs 48 and 49 (see FIG. 5 for both) respectively. Thus, the first and second engaging portions 43*a* and 45*a* are pressed against the outer circumferential edge of the guide hole 63 in the radial direction. Thus, the roller holder 47 rotates counter-clockwise along with the switching cam 50.

Figure 13:
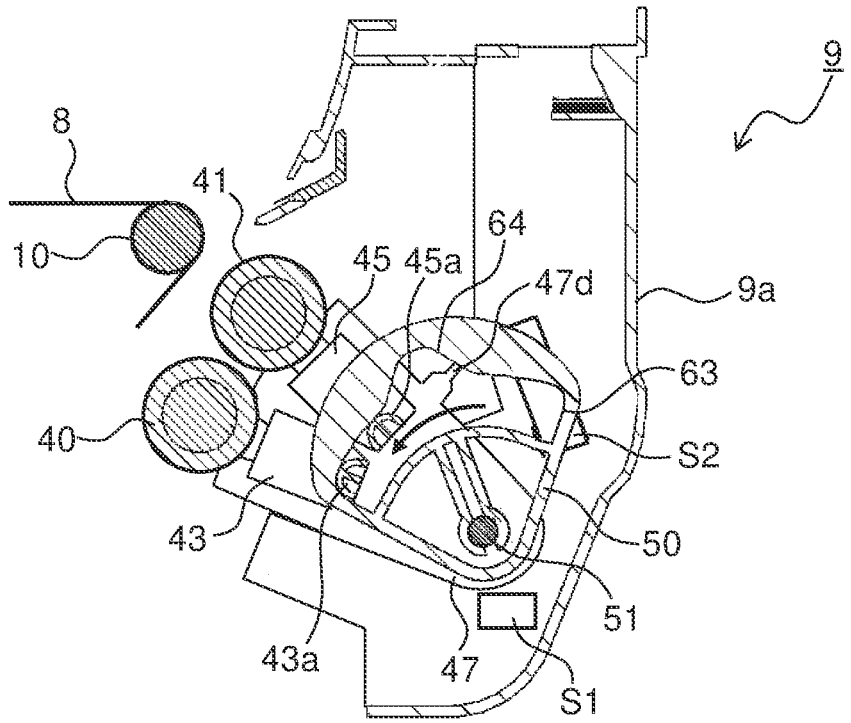
FIG. 13 is a diagram showing a state where a shaft is rotated counter-clockwise from the state in FIG. 12 so that a second roller faces a driving roller.

Then, when the roller holder 47 rotates until it makes contact with a restriction rib 9*c* (see FIG. 5), as shown in FIG. 13, the second roller 41 is arranged at a position opposite the driving roller 10. In the state in FIG. 13, the first light-shielding plate 51*a* is retracted from the sensing portion of the first position sensor S1 (*off*), and the second light-shielding plate 47*d* on the roller holder 47 is retracted from the sensing portion of the second position sensor S2 (*off*). That is, when the sensing state changes from the one in FIG. 12 (S1 off/S2 on) to the one in FIG. 13 (S1/S2 off), the second roller 41 can be sensed to have moved to the position opposite the driving roller 10.

Figure 14:
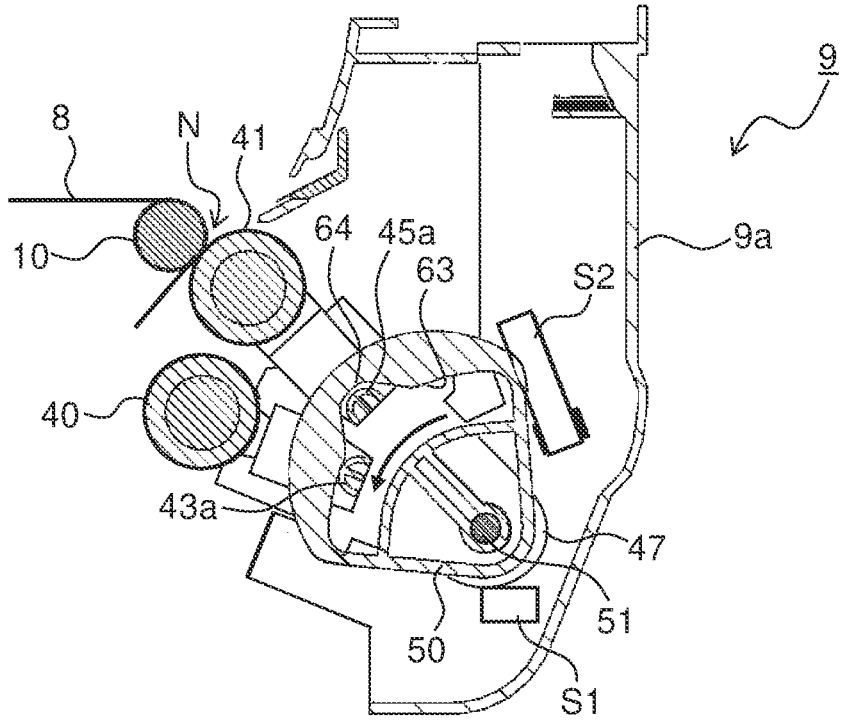
FIG. 14 is a diagram showing a state where the switching cam is rotated counter-clockwise from the state in FIG. 13 through a predetermined angle and the second roller is arranged at the reference position to form the secondary transfer nip.

FIG. 14 is a diagram showing a state where the switching cam 50 is rotated counter-clockwise from the state in FIG. 13 through a predetermined angle. When the shaft 51 is rotated counter-clockwise, the switching cam 50 rotates along with the shaft 51. On the other hand, the roller holder 47 is restrained from counter-clockwise rotation by the restriction rib 9*c* (see FIG. 5). As a result, the second engaging portion 45*a* of the second bearing member 45 moves to the bottom portion 64*a* of the recessed portion 64, and the second bearing member 45 moves in a direction away from the shaft 51 under the urging force of the second coil spring 49 (see FIG. 5).

As a result, the second roller 41 is kept in pressed contact with the driving roller 10 via the intermediate transfer belt 8 to form the secondary transfer nip N and rotates by following the driving roller 10. To the second roller 41, a transfer voltage of the polarity (here, negative) opposite to that of toner is applied by the transfer voltage power supply 74 (see FIG. 8). Specifically, when the second roller 41 is arranged at the position in FIG. 14, the transfer voltage is applied to it via the second bearing member 45 that is electrically connected to the transfer voltage power supply 74.

The first light-shielding plate 51*a* on the shaft 51 shields light from the sensing portion of the first position sensor S1 (on), and the second light-shielding plate 47*d* on the roller holder 47 is retracted from the sensing portion of the second position sensor S2 (*off*). This state (S1 on/S2 off) is taken as the reference position (home position) of the second roller 41. That is, when the sensed state changes from the one in FIG. 13 (S1/S2 off) to the one in FIG. 14 (S1 on/S2 off), the second roller 41 can be sensed to have moved to the reference position. By restricting the rotating angle of the switching cam 50 based on the rotation time of the switching cam 50 from the reference position, the arrangement and the released state of the second roller 41 are controlled.

Figure 15:
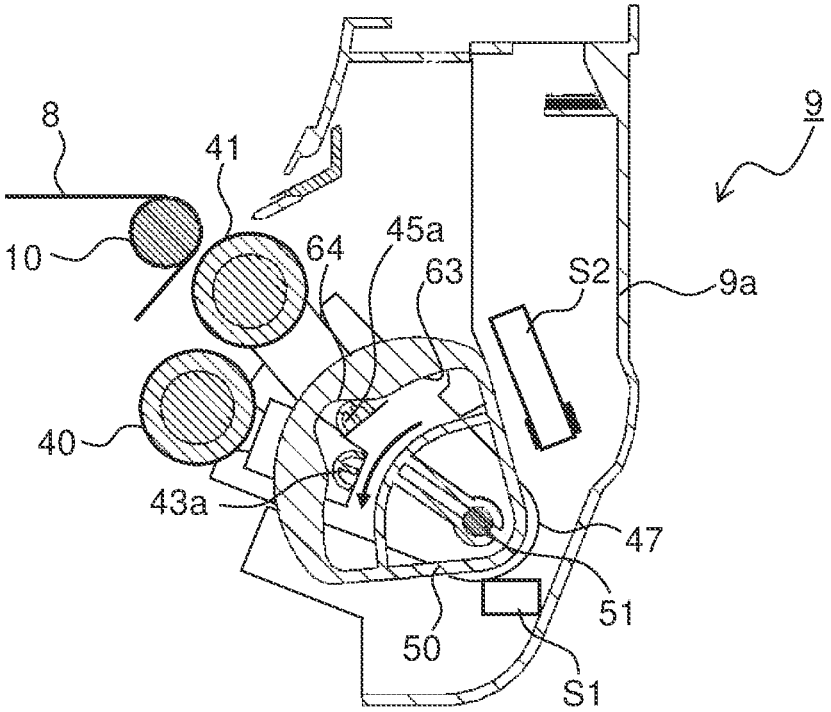
FIG. 15 is a diagram showing the first released state of the second roller where the switching cam is rotated further counter-clockwise from the state in FIG. 14 through a predetermined angle.

FIG. 15 is a diagram showing a state where the switching cam 50 is rotated further counter-clockwise from the state in FIG. 14 through a predetermined angle (here, 10.6° from the reference position in FIG. 14). When the shaft 51 is rotated further counter-clockwise, the switching cam 50 rotates further counter-clockwise along with the shaft 51. On the other hand, the roller holder 47 is restrained from counter-clockwise rotation by the restriction rib 9*c* (see FIG. 5). As a result, the second engaging portion 45*a* of the second bearing member 45 moves from the bottom portion 64*a* to the inclined portion 64*b* of the recessed portion 64, and the second bearing member 45 moves in the direction toward the shaft 51 against the urging force of the second coil spring 49 (see FIG. 5). Thus, the second roller 41 lies slightly (2 mm) away from the intermediate transfer belt 8 (the first released state).

When the second roller 41 is kept in pressed contact with the driving roller 10 for a long time, the second roller 41 may yield and deform in the axial direction. To avoid that, after a job, the second roller 41 needs to be kept away from the intermediate transfer belt 8 (driving roller 10). This is achieved in the first released state shown in FIG. 15. When calibration is executed during use of the second roller 41, the second roller 41 is brought into the first released state so that the reference image formed on the intermediate transfer belt 8 does not adhere to the second roller 41. When calibration is executed while the second roller 41 is in the first released state, it is possible to form a reference image in a middle part of the intermediate transfer belt 8 in the width direction.

The first light-shielding plate 51*a* on the shaft 51 is retracted from the sensing portion of the first position sensor S1 (*off*), and the second light-shielding plate 47*d* on the roller holder 47 is kept retracted from the sensing portion of the second position sensor S2 (*off*). That is, when the sensing state changes from the one in FIG. 14 (S1 on/S2 off) to the one in FIG. 15 (S1/S2 off), the second roller 41 can be sensed to have moved from the reference position to the first released state.

Figure 16:
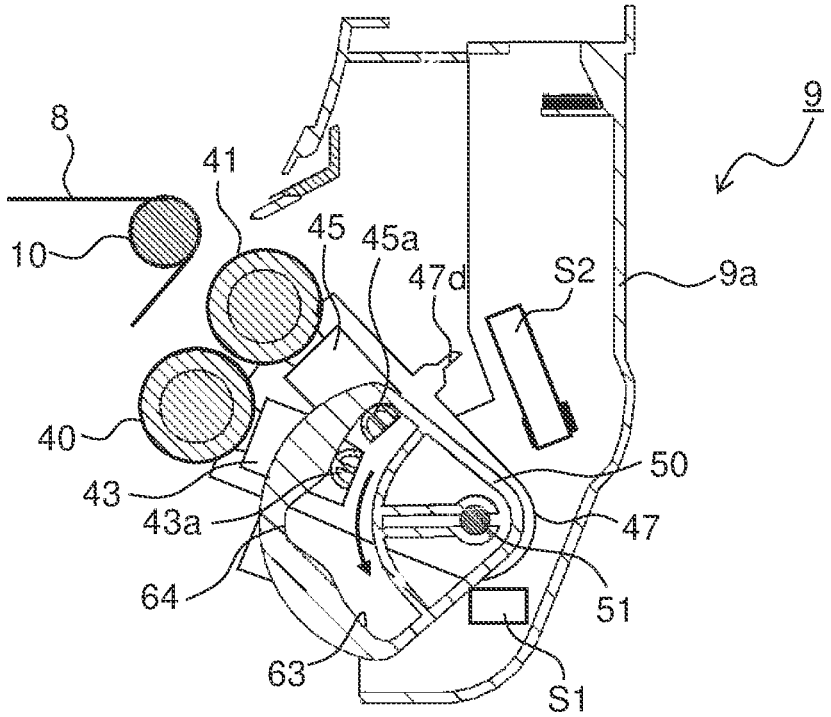
FIG. 16 is a diagram showing the second released state of the second roller where the switching cam is rotated further counter-clockwise from the state in FIG. 15 through a predetermined angle.

FIG. 16 is a diagram showing a state where the switching cam 50 is rotated further counter-clockwise from the state in FIG. 15 through a predetermined angle (here, 46.6° from the reference position in FIG. 14). When the shaft 51 is rotated further counter-clockwise, the switching cam 50 rotates further counter-clock wise along with the shaft 51. On the other hand, the roller holder 47 is restrained from counter-clockwise rotation by the restriction rib 9*c* (see FIG. 5). As a result, the second engaging portion 45*a* of the second bearing member 45 moves away from the recessed portion 64, and the second bearing member 45 moves further in the direction toward the shaft 51 against the urging force of the second coil spring 49 (see FIG. 5). Thus, the second roller 41 lies completely (6.5 mm) away from the intermediate transfer belt 8 (the second released state). The second released state is used only for switching from the second roller 41 to the first roller 40.

The sensing state of the first and the second position sensors S1 and S2 in FIG. 16 is similar to that in the first released state (S1/S2 off) shown in FIG. 15. Thus, when the S1/S2 off state is sensed as the image forming apparatus 100 starts up, the roller holder 47 is rotated for a given period in the direction toward the double-sided conveyance path 18 (clockwise) to distinguish between the first and second released states. Then, if the S1 on/S2 off state occurs, the first released state is recognized and, if the S1 on/S2 off state does not occur, the second released state is recognized.

To shift the second roller 41 in the second released state back to the reference position, it is necessary to rotate the roller holder 47 and the switching cam 50 clockwise first to switch to the reference position of the first roller 40 (see FIG. 9) and then to switch back to the reference position of the second roller 41 (see FIG. 14).

Figure 17:
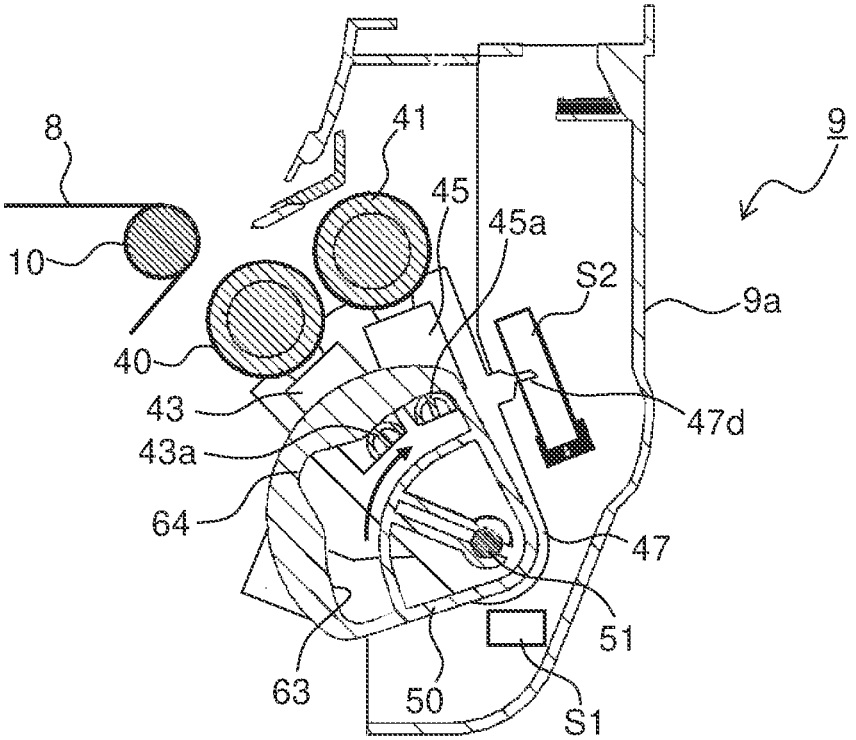
FIG. 17 is a diagram showing a state where the switching cam is rotated clockwise from the state in FIG. 16 through a predetermined angle so that the first roller faces the driving roller.

When the roller that forms the secondary transfer nip N is switched from the first roller 40 to the second roller 41, the switching cam 50 is rotated from the state in FIG. 16 clockwise through a predetermined angle. As a result, the roller holder 47 rotates clockwise along with the switching cam 50 through the predetermined angle. When the roller holder 47 rotates until it makes contact with the restriction rib 9*b*, the first roller 40 goes into the state shown in FIG. 17 where the first roller 40 faces the driving roller 10. When the switching cam 50 is rotated further from the state in FIG. 17 clockwise through a predetermined angle, the first roller 40 goes into the state shown in FIG. 9 where the first roller 40 is arranged at the reference position. Through repetition of the procedure described above, switching between the first and second rollers 40 and 41 is achieved.

Figure 18:
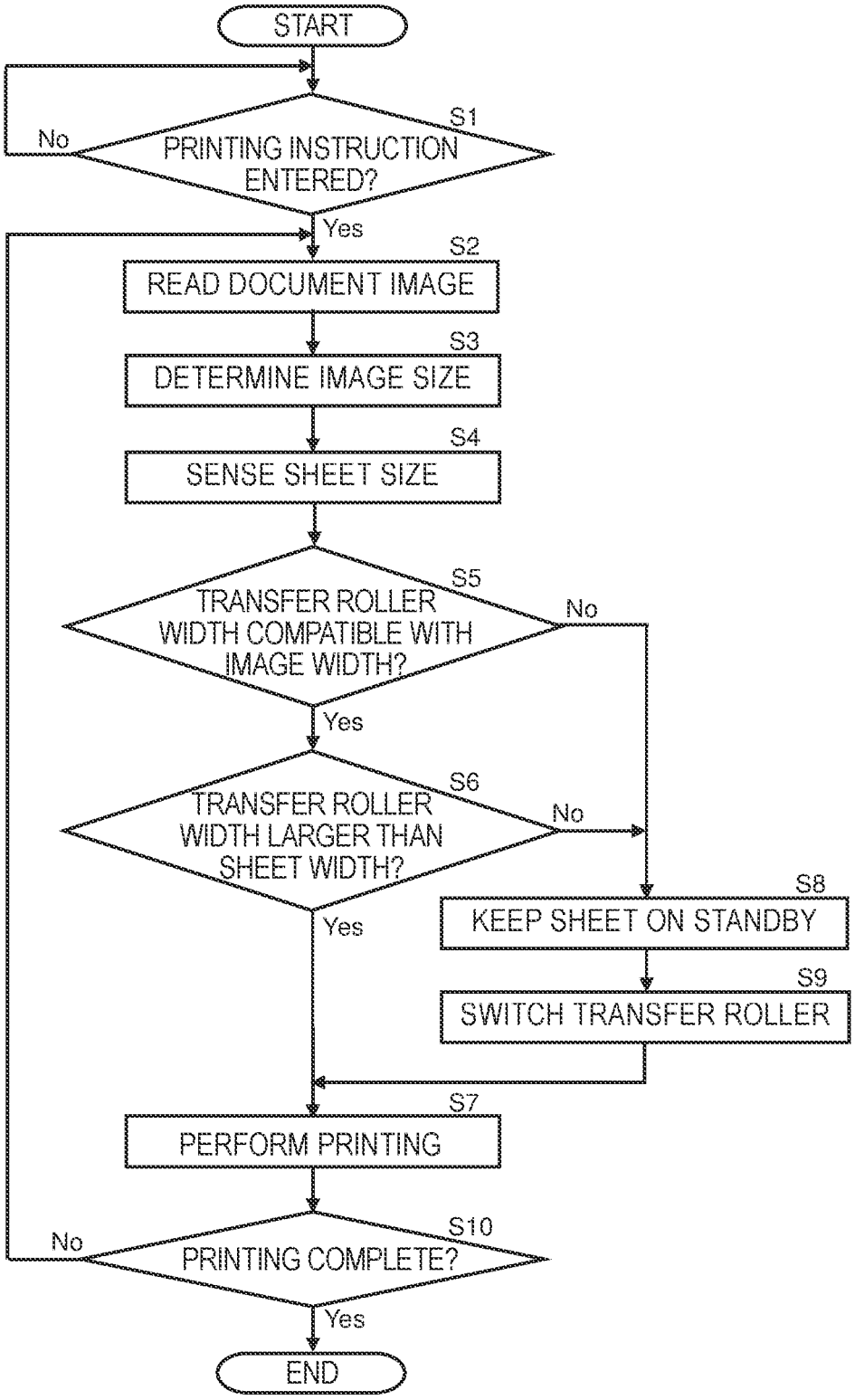
FIG. 18 is a flow chart showing an example of roller switching control for the secondary transfer unit performed in the image forming apparatus according to the embodiment.

FIG. 18 is a flow chart showing an example of the roller switching control for the secondary transfer unit 9 performed in the image forming apparatus 100 according to the embodiment. With reference also to FIGS. 1 to 17 as necessary, the procedure for switching between the first and second rollers 40 and 41 that constitute the secondary transfer unit 9 will be described along the steps in FIG. 18.

First, the control portion 90 checks whether a printing instruction is received (step S1). If no printing instruction is received (No in step S1), a printing standby state is continued. If a printing instruction is received (Yes in step S1), reading of a document image by the image reading portion 20 is executed (step S2). Then, based on the read image data, the image size (image width) is determined (step S3). Then, based on the determined image size, sheets S are supplied from the sheet cassette 16, and the sheet size (sheet width) is sensed by the CIS 26 (step S4).

Next, the control portion 90 judges whether the roller width of the secondary transfer roller arranged at the reference position is compatible with the image width determined in step S3 (step S5). If the roller width is compatible with the image width (Yes in step 5), whether the roller width is larger than the sheet width sensed in step S4 is checked (step S6).

If the roller width is larger than the sheet width (for example, the first roller 40 is arranged at the reference position and the sheet width is smaller than the A3 size (Yes in step S6), the control portion 90 performs printing through the ordinary image forming operation. Specifically, the image forming portions Pa to Pd start to be driven, and the toner image formed on the intermediate transfer belt 8 is transferred to the sheet S as it passes through the secondary transfer nip N. The transfer voltage is applied to the first roller 40.

On the other hand, if the roller width is not compatible with the image width (No in step S5) such as when the image width is that of the 13 inch-size sheet and the first roller 40 is arranged at the reference position, or when the image width is that of the A4-size sheet and the second roller 41 is arranged at the reference position, and also if the roller width is smaller than the sheet width (for example, when the first roller 40 is arranged at the reference position and the sheet size is the 13 inch-size (No in step S6), the control portion 90 stops the conveyance of the sheet S and keeps the sheet S on standby between the pair of registration rollers 12*b* (step S8) and in addition switches the secondary transfer roller (step S9). Specifically, the control portion 90 transmits a control signal to the roller switching motor 55 to rotate the roller holder 47 through a predetermined angle so as to arrange the first or second roller 40 or 41 at the reference position. It then performs printing through the ordinary image forming operation (step S7).

Then, the control portion 90 checks whether the printing operation is complete (step S10), and if printing continues (No in step S10), the procedure returns to step S2 and a similar procedure is repeated (step S2 to S10). If printing is complete (Yes in step S10), the procedure is ended.

With the configuration according to the embodiment, if the roller width (dimension of the elastic layer 40*b* in the axial direction) of the first roller 40 arranged at the reference position is not compatible with the image width or smaller than the sheet width, a switch is made to the second roller 41 with the larger elastic layer 41*b* in the axial direction. If the roller width (dimension of the elastic layer 41*b* in the axial direction) of the second roller 41 arranged at the reference position is not compatible with the image width or larger than the sheet width, a switch is made to the first roller 40 with the smaller elastic layer 40*b* in the axial direction.

In this way, it is possible to use the appropriate secondary transfer roller in accordance with the image width and the sheet width, and this helps effectively suppress secondary transfer failure and soiling of the back of the sheet S due to adhesion of toner to the secondary transfer roller. Furthermore, it is not necessary to perform a cleaning operation to move the toner deposited on the first roller 40 back to the intermediate transfer belt 8, and this helps reduce printing wait time.

If the image width is small, the first roller 40 with a smaller roller width can be used. Then, when calibration is performed during image formation in which the reference image is formed on the intermediate transfer belt 8 outside the image area in the width direction (outside the first roller 40 in the axial direction), the reference image formed on the intermediate transfer belt 8 does not make contact with the first roller 40. Thus, calibration can be performed during image formation, and this helps improve image quality without a drop in image processing efficiency (productivity).

It is also possible to sense the sheet width of the sheet S being conveyed with the CIS 26 and the LED 27, so that switching between the first roller 40 and the second roller 41 can be performed in accordance with the sensed sheet width. Thus, it is possible to select the appropriate secondary transfer roller even if the previously set sheet size and the actually conveyed sheet size disagree because, for example, a user has entered the wrong sheet size on the operation section 80 or has put sheets S of the wrong size in the sheet cassette 16.

In this embodiment, with a simple configuration using the roller holder 47 and the switching cam 50, it is possible to arrange one of the first and second rollers 40 and 41 opposite the driving roller 10 and to selectively arrange the first or second roller 40 or 41 arranged opposite the driving roller 10 either at the reference position at which it forms the secondary transfer nip N or at the released position at which it lies away from the intermediate transfer belt 8.

In this embodiment, it is possible to switch the released position of the first roller 40 and the second roller 41 between the first released state with a smaller distance from the intermediate transfer belt 8 and the second released state with a larger distance from it. Thus, after a job, laying the first and second rollers 40 and 41 in the first released state helps reduce the time until they are arranged at the reference position to form the secondary transfer nip N. It is thus possible to minimize a drop in image processing efficiency (productivity) due to the movement of the first and second rollers 40 and 41.

Furthermore, in this embodiment, it is possible to drive the roller holder 47 and the switching cam 50 with the single roller switching motor 55. Thus, compared to a configuration where the roller holder 47 and the switching cam 50 are driven with separate motors, the driving mechanism and the driving control can be simplified, and this helps reduce the cost and the size of the image forming apparatus 100.

Figure 19:
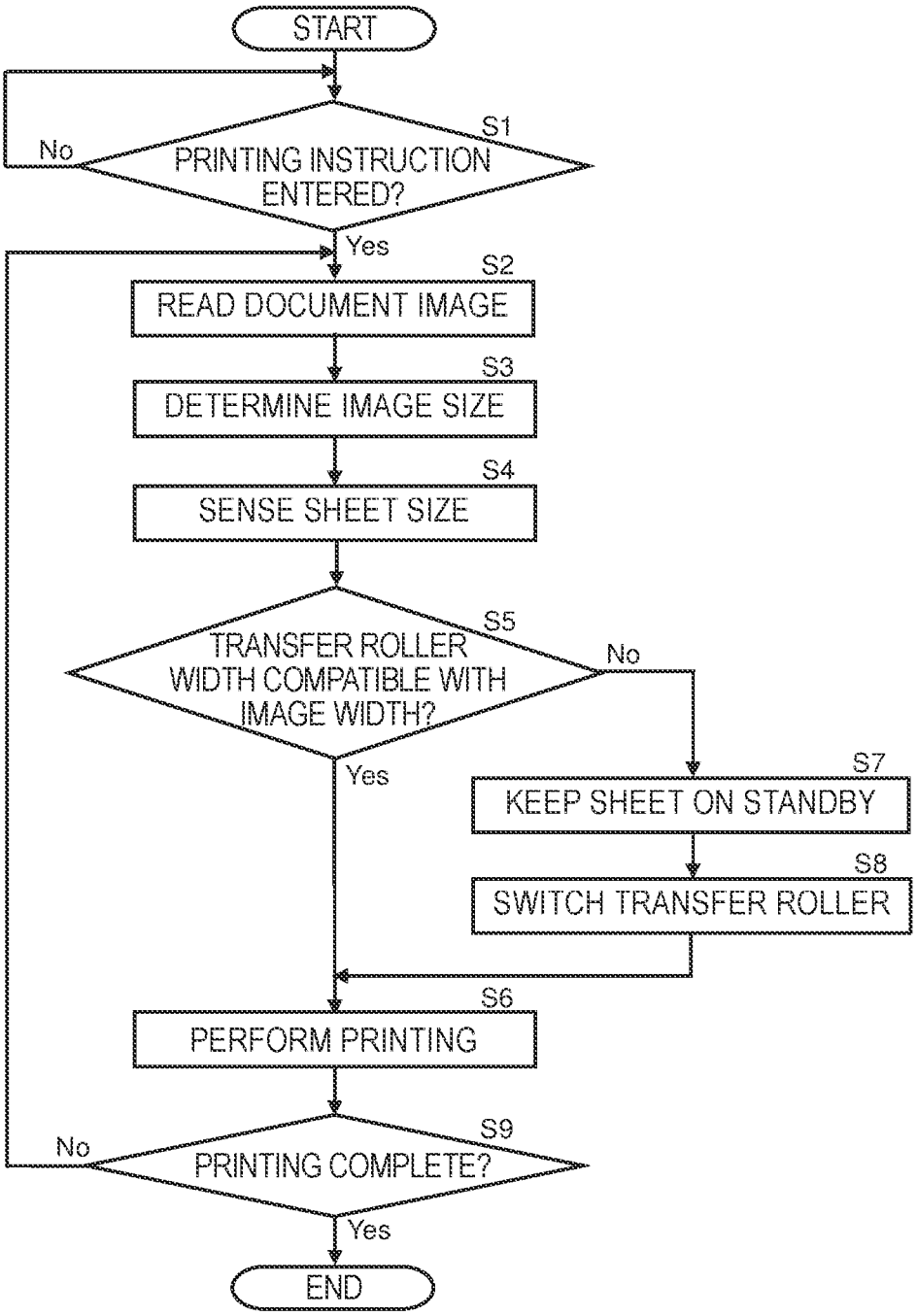
FIG. 19 is a flow chart showing another example of the roller switching control for the secondary transfer unit performed in the image forming apparatus according to the embodiment.

FIG. 19 is a flow chart showing another example of the roller switching control in the secondary transfer unit 9 performed in the image forming apparatus 100 according to the embodiment. The example shown in FIG. 19 does not include the step (step S6 in FIG. 18) for judging whether the roller width is larger than the sheet width determined in step S4. That is, when the roller width is larger than the image width (Yes in step S5), even if the sheet width changes during continuous printing, printing is performed without a switch from the first roller 40 to the second roller 41 or from the second roller 41 to the first roller 40 (step S6). In other respects, the procedure is similar to that in FIG. 18.

In the example shown in FIG. 19, when the roller width is larger than the image width, even if the sheet width changes during continuous printing, the secondary transfer roller is not switched. This helps suppress a drop in image forming efficiency (productivity) resulting from the secondary transfer roller being switched every time the sheet size changes during continuous printing. When the first roller 40 is arranged at the reference position and the sheet width is larger than the roller width (13 inch size), the sheet S has areas in its opposite edge parts in the width direction with which the elastic layer 40*b* does not make contact. However, the elastic layer 40*b* makes contact with at least the image area, providing satisfactory transferability.

The embodiment described above is in no way meant to limit the present disclosure, which thus allows for many modifications and variations within the spirit of the present disclosure. For example, the shapes and the dimensions of the first roller 40, the second roller 41, the roller holder 47, the switching cam 50 that constitute the secondary transfer unit 9 are merely examples and can be freely modified without spoiling the effect of the present disclosure.

Although the above embodiment deals with, as an example, an intermediate transfer-type image forming apparatus 100 provided with the secondary transfer unit 9 that secondarily transfers the toner image that has been primarily transferred to the intermediate transfer belt 8 to the sheet S, what is disclosed herein is applicable similarly to any other transfer units mounted on a direct transfer-type image forming apparatus in which a toner image formed on the photosensitive drum is directly transferred to the sheet.

The present disclosure is applicable to an image forming apparatus provided with a transfer unit for transferring a toner image formed on an image carrying member to a recording medium. Based on the present disclosure, it is possible to provide an image forming apparatus that can selectively switch, with appropriate timing, between two transfer rollers to be kept in pressed contact with the image carrying member.

What is claimed is:

1. An image forming apparatus, comprising:

an image forming portion that forms a toner image on an image carrying member;

an image input portion that receives image data of the toner image formed by the image forming portion;

a transfer unit that includes a transfer roller having a metal shaft and an elastic layer laid around an outer circumferential face of the metal shaft to form a transfer nip by keeping the elastic layer in pressed contact with the image carrying member, the transfer unit transferring the toner image formed on the image carrying member to a recording medium as the recording medium passes through the transfer nip;

a transfer voltage power supply that applies a voltage to the transfer roller; and a control portion that controls the image forming portion, the transfer unit, and the transfer voltage power supply, wherein the transfer unit includes, as the transfer roller, a first roller and a second roller, the elastic layer of the second roller being larger in an axial direction than the elastic layer of the first roller, and the control portion arranges one of the first and second rollers at a reference position at which the first or second roller is in pressed contact with the image carrying member and forms the transfer nip in accordance with a width-direction size of the image data that has been fed to the image input portion and a width-direction size of the recording medium.

2. The image forming apparatus according to claim 1, wherein the image input portion is an image reading portion that reads a document image to convert the document image to the image data, and the control portion arranges one of the first and second rollers at the reference position in accordance with a width-direction size of the document image that is read in the image reading portion.

3. The image forming apparatus according to claim 2, further comprising a size sensing portion that senses the width-direction size of the recording medium that is conveyed to the image forming portion, wherein when an axial-direction length of the elastic layer of the first or second roller arranged at the reference position is not compatible with the width-direction size of the image data and the width-direction size of the recording medium sensed by the size sensing portion, the control portion stops conveyance of the recording medium and arranges at the reference position the first or second roller having the elastic layer compatible with the width-direction size of the image data and the recording medium.

4. The image forming apparatus according to claim 3, wherein the size sensing portion includes a contact image sensor having a large number of sensing portions comprising photoelectric conversion elements arranged in a width direction of the recording medium, and a light emitting portion that emits light to the contact image sensor, and the size sensing portion senses a width-direction edge part of the recording medium in the width direction based on a difference in light intensity between in a part of the size sensing portion directly struck by the light emitted from the light emitting portion and a part of the size sensing portion shielded from the light by the recording medium.

5. The image forming apparatus according to claim 2, wherein if the axial-direction length of the elastic layer of the first or second roller arranged at the reference position is larger than the width-direction size of the image data, even when the width of the recording medium changes during continuous printing, the control portion does not switch the first or second roller arranged at the reference position.

6. The image forming apparatus according to claim 1, wherein the control portion arranges the first or second roller arranged opposite the image carrying member selectively either at the reference position or at a released position at which the first or second roller lies away from the image carrying member.

7. The image forming apparatus according to claim 6, wherein the transfer unit includes a first bearing member that rotatably supports the first roller, a second bearing member that rotatably supports the second roller, a roller holder having a first bearing holding portion and a second bearing holding portion that hold the first bearing member and the second bearing member respectively so as to be slidable in directions toward and away from the image carrying member, a first urging member that is arranged between the first bearing holding portion and the first bearing member and urges the first bearing member in the direction toward the image carrying member, a second urging member that is arranged between the second bearing holding portion and the second bearing member and urges the second bearing member in the direction toward the image carrying member, a switching cam that has a guide hole with which a first engaging portion formed on the first bearing member and a second engaging portion formed on the second bearing member engage, and a driving mechanism that drives the roller holder and the switching cam to rotate, wherein by rotating the roller holder, one of the first and second rollers is arranged opposite the image carrying member, and by rotating the switching cam to change positions at which the first and second engaging portions engage with the guide hole, the first or second roller that is arranged opposite the image carrying member is arranged selectively either at the reference position or at the released position.

8. The image forming apparatus according to claim 7, wherein the driving mechanism includes a shaft that is fixed to a rotation center of the switching cam, and a roller switching motor for rotating the shaft, and the roller holder is rotatably supported on the shaft and, by rotating the shaft with the roller switching motor, rotates the switching cam and the roller holder.

9. The image forming apparatus according to claim 7, further comprising a plurality of position sensors that sense positions of the roller holder and the switching cam in a rotation direction, wherein by controlling the driving mechanism based on a result of sensing by the plurality of position sensors, the control portion arranges one of the first and second rollers opposite the image carrying member and arranges the first or second roller arranged opposite the image carrying member selectively either at the reference position or at the released position.

10. The image forming apparatus according to claim 1, further comprising:

a plurality of image forming portions that form toner images of different colors;

an endless intermediate transfer belt as the image carrying member that moves along the plurality of image forming portions;

a plurality of primary transfer members that are arranged, across the intermediate transfer belt, opposite photosensitive drums arranged respectively in the plurality of image forming portions and that primarily transfer the toner images formed on the photosensitive drums to the intermediate transfer belt; and a secondary transfer unit as the transfer unit that secondarily transfers the toner images primarily transferred to the intermediate transfer belt to the recording medium.

* * * * *